US006958109B1

(12) United States Patent
Heikkila et al.

(10) Patent No.: US 6,958,109 B1
(45) Date of Patent: Oct. 25, 2005

(54) PROCESS FOR FEEDING PULP INTO A BLOW TANK OR STORAGE TANK

(75) Inventors: Martti Heikkila, Mārynummi (FI); Kari Kovasin, Rauma (FI); Karl-Erik Róberg, Salo (FI); Olavi Toukonummi, Hajala (FI)

(73) Assignee: Sulzer Pumpen AG, Winterthur (CH)

( * ) Notice: Subject to any disclaimer, the term of this patent is extended or adjusted under 35 U.S.C. 154(b) by 0 days.

(21) Appl. No.: 09/913,331

(22) PCT Filed: Feb. 2, 2000

(86) PCT No.: PCT/FI00/00067

§ 371 (c)(1),
(2), (4) Date: Oct. 11, 2001

(87) PCT Pub. No.: WO00/49222

PCT Pub. Date: Aug. 24, 2000

(30) Foreign Application Priority Data

Feb. 15, 1999 (FI) ..... 990290

(51) Int. Cl.[7] ..... D21C 007/06; D21C 007/008

(52) U.S. Cl. ..... 162/52; 162/246; 162/258

(58) Field of Search ..... 162/52, 246, 49, 162/61, 258

(56) References Cited

U.S. PATENT DOCUMENTS 6,098,658 A 8/2000 Toukonummi

FOREIGN PATENT DOCUMENTS

| | | |
|---|---|---|
| FI | 944442 | 5/1995 |
| WO | WO 93/09059 | 5/1993 |

OTHER PUBLICATIONS

Fast, Reactive Power Support, *HTS Generators*, American Superconductor™ (Feb. 27, 2001)pp. 1-4.

*Primary Examiner*—Steve Alvo
(74) *Attorney, Agent, or Firm*—Nixon & Vanderhye, P.C.

(57) ABSTRACT

A method and apparatus for treating pulp being fed into a blow tank or a storage tank. A preferred embodiment is that the pulp is discharged from a batch digester (10) and fed either to the upper or lower part of a blow tank (20), depending on the consistency of the pulp being discharged from the digester.

25 Claims, 2 Drawing Sheets

PROCESS FOR FEEDING PULP INTO A BLOW TANK OR STORAGE TANK

Figure 1:
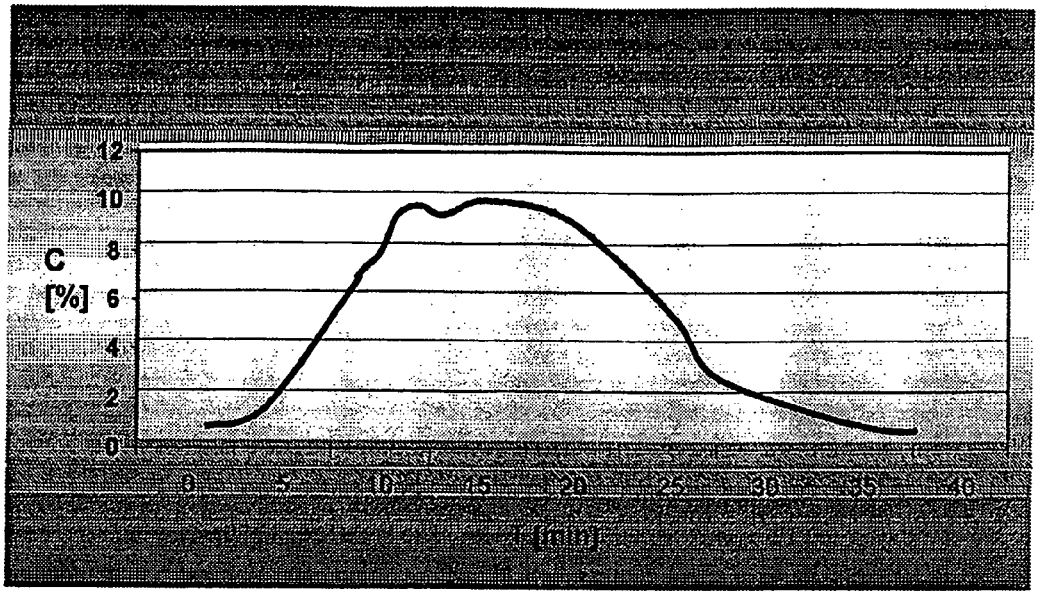
Fig. 1 (PRIOR ART)

The present invention relates to a method and apparatus for treating pulp. A problem resulting in the development of the method and apparatus according to the invention becomes especially obvious during the feed and discharge of blow tanks used in connection with batch digesters. Thus, putting it more precisely, the method and apparatus according to the invention relate to the filling and discharging of various pulp tanks and storage containers.

It is known from prior art that a so-called blow tank is used in connection with batch cooking departments. Contrary to continuous cooking, batch cooking is understood to be a pulp production method in which the cooking department comprises several digesters, most commonly 5–10 in one cooking department. Each of said digesters in turn is filled with chips and cooking chemicals which are allowed to effect the chips for a certain period of time, after which the digester is discharged to a so-called blow tank. The timing of the feedings and discharges of the digesters is effected so that the blow tank is filled at fairly regular intervals. The blow tank is meant to function as an intermediate storage, blow container, of the cooked pulp, from which the pulp is discharged in an even flow to the next, invariably continuously operating process.

A problem discovered in operating said blow tanks is that the consistency of pulp being discharged from the blow tank does not remain within ranges required by the following process stage, i.e. the brown stock washing department. A reason for this is that each digester has its own way of discharging depending on e.g. the operator, the uniformity and execution of the cook in general as well as the raw wood material and pulp quality. During the discharge process, the consistency of the pulp may vary even between zero and ten percent. A reason for this consistency variation is that in the beginning of the discharge process practically only liquor is discharged from the digester, because after the so-called final displacement which in modern batch cooking processes is the last process prior to the discharge of the digester, there is a certain amount of displacement liquor in the bottom part of the digester. This is naturally discharged from the digester first, before the actual pulp. During the discharge, and more intensively towards the end of the discharge, the pulp has to be diluted in order to make it flow from the digester to the discharge pump. Just at the final stage of the discharge, the pulp has to be diluted even more, as the hydrostatic pressure under which the pulp is discharged from the tank is substantially lower than in the beginning of the discharge due to low height of the pulp column.

In the blow tank, the consistency variation often results in channeling of the pulp so that at various locations of the blow tank the consistency of the pulp alters to a large extent. Although the blow tank is provided with one or several mixers, our experience has shown that these are not capable of equalizing the consistency of the pulp in all conditions, but the pulp is discharged from the tank to the following process stage at an unsuitable consistency. In the worst case, the consistency of the pulp is decreased in the mixing zone of the tank far below the desired values.

A second problem consists in filtration of the pulp to form a cake on the surface of the pulp existing in the blow tank. A direct reason for this is the lack of motion in the upper part of the mixing zone and the fact that the pulp being discharged from the digester always contains air and gases originating from the cook which are not easily removed from the pulp. This phenomenon is also dependent on the quality and type of pulp. Especially when running the tank in order to empty it or sometimes even in normal running situations, depending on the surface level, said filtrated pulp causes remarkable consistency variations when entering the mixing zone at the bottom part of the tank, which consistency variations can not be equalized in the mixing zone, but the pulp is discharged further at too high a consistency.

FIG. 1 illustrates the consistency variation of pulp during the blow of one digester. As already stated earlier, the consistency of the pulp varies to a great extent during the discharge, being low both in the beginning and in the end due to reasons stated before. In the middle stage of the blow the consistency of the pulp may be in the order of ten percent. The time interval between two blows is in the order of 20–40 minutes depending on the size and number of digesters. In our tests we have noticed that said interval of about half an hour is sufficient to cause the pulp on the surface in the blow tank to filtrate, i.e. thicken, whereby onto the surface of the pulp existing in the tank a relatively solid, and continuously solidifying, cake is formed.

Figure 2A:
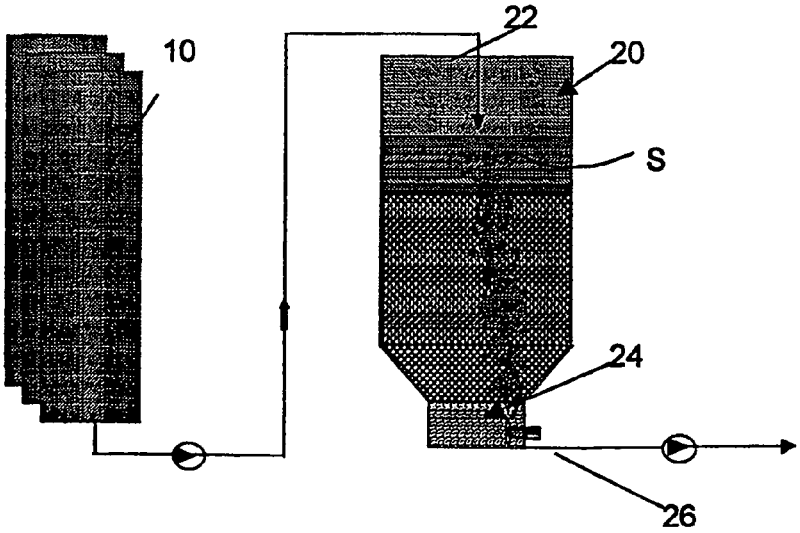
Fig. 2a (PRIOR ART)

FIG. 2*a* illustrates a case in which the digester is discharged to a blow tank via a conduit arranged at the upper end of the tank. In this case it is obvious that the pulp is discharged, if no auxiliary means distributing the flow are used, with considerably great force deep into the pulp already existing in the tank. Thus, in the one hand, the pulp filtered on the surface in the blow tank cannot at any stage enter the mixing zone, except if the tank is being run to empty it or to lower the surface level, but the pulp starts to be collected on the surface in the tank. At the worst case the pulp may start to deteriorate, if the hardened pulp cake remains in the tank for a long period of time. On the other hand, the dilute pulp discharged deep into the pulp existing in the tank forms a local agglomeration, which at some stage when the blow tank is being evenly discharged is suddenly discharged into the mixing zone decreasing the consistency of pulp being discharged from the tank to below the desired values.

FI patents 98836 and 100011 deal partly with the same problem and suggest as a solution various apparatuses by means of which it is possible to somewhat restrict the downward flow of pulp entering the mixing zone or on the other hand fill the blow tank better than before.

Figure 2B:
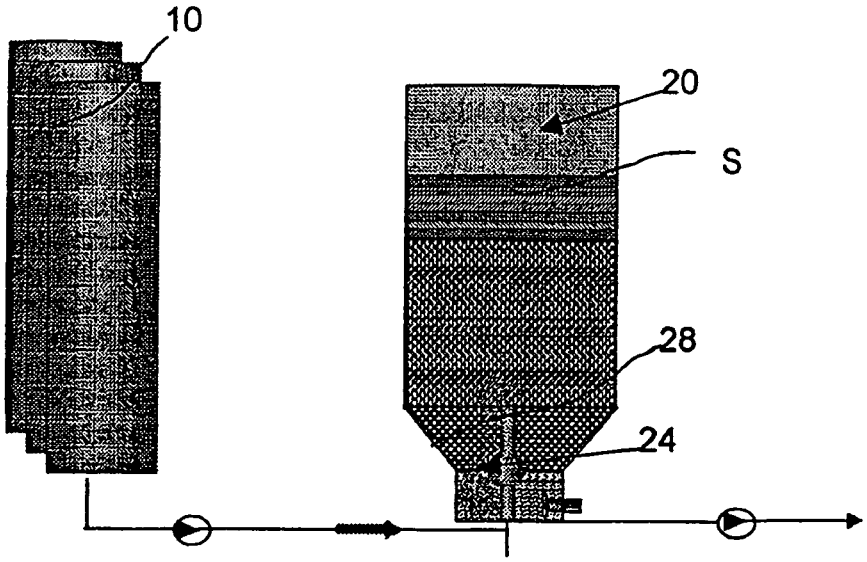
Fig. 2b (PRIOR ART)

Said better filling of the blow tank is illustrated in FIG. 2*b* where it can be seen how the apparatus according to FI patent 100011 is used to feed pulp into the tank via the bottom part of the tank to a certain altitude. Although said solution does help in many problems related to the filling of the tank, FIG. 2*b* illustrates also a situation where dilute pulp is being discharged to the tank through the apparatus. This channels directly from the inlet opening of the feeding apparatus towards the mixing zone, resulting in principle in the same kind of situation as the solution according to FIG. 2*a*.

Naturally, when treating pulp, problems of the same kind appear not only in connection with blow tanks but elsewhere as well, e.g. in connection with pulp storage tanks at various stages of the pulp treatment process.

Said problems are suggested to be solved by an arrangement where part of the pulp is discharged into the tank via its upper part and part of the pulp through the lower part of the tank. Further, the pulp discharged via the upper part of the tank is in the upper part of the tank distributed evenly onto the whole cross section of the tank, whereby even the pulp discharged from the upper part of the tank is not capable of penetrating deep into the pulp existing in the tank, but stays on the surface of the pulp, thus ensuring that the consistency of the pulp remains uniform at various locations in the storage tank and that the pulp flows evenly at a relatively uniform consistency downwards to the mixing zone.

The operating model described above solves a third problem, too, viz. a disadvantage related to the energy consumption of the filling of blow and storage tanks. It has namely been noticed that especially when the tanks are filled through an inlet opening arranged at the upper end of the tank only, remarkable amount of pumping energy is lost due to great fluctuations in the pulp level in the tank. Pumping the pulp to the altitude of the upper end of the tank and letting it drop from there to the bottom of the tank is mere waste of energy. By utilizing the solution according to the invention described above, part of the tank, according to a preferred example half of the tank, i.e. the bottom part of it, is filled substantially through a feed inlet at the bottom of the tank and only the upper part of the tank through a feed inlet located essentially at the upper end of the tank. When filling the tank through the bottom thereof, at the bottom of the tank there is preferably provided a filling device according to FI-patent 100011 and accordingly at the upper end of the tank there is preferably provided a filling device according to FI-application 971330. With the described method, about a third of the pumping energy is saved compared to filling the tank through the upper end, naturally depending on the average altitude level of the pulp in the tank.

Other characterizing features of the method and apparatus according to the invention are disclosed in the appended claims.

Figure 3:
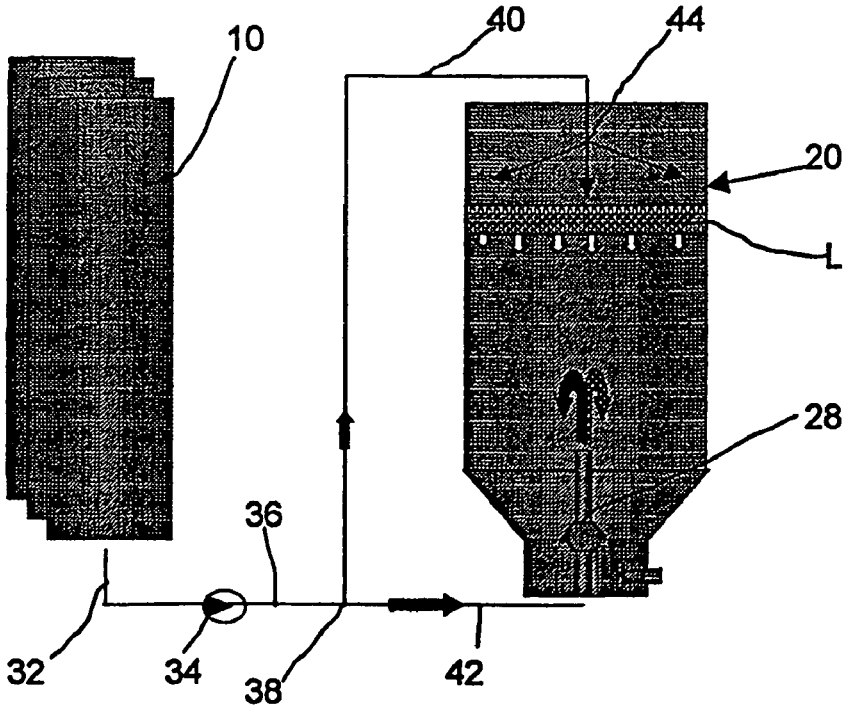

In the following, the method and apparatus according to the invention are explained in more detail with reference to the appended figures, of which FIG. 1 illustrates the change of discharge consistency in a discharge process of a prior art batch digester as a function of time, FIG. 2*a* illustrates a blow arrangement of a prior art batch digester, FIG. 2*b* illustrates a blow arrangement of a second prior art batch digester, FIG. 3 illustrates a solution according to a preferred embodiment of the invention applied to the blow arrangement for a batch digester.

FIG. 1 illustrates the consistency variation of the pulp during the blow of one digester. As already stated, the consistency is low both in the beginning and in the end of the discharge. In about the middle stage of the blow the consistency of the pulp may be in the order of about ten percent. The time interval between two blows is about 20–40 minutes, depending on the size and number of digesters. In our studies we have noticed that said interval in the order of about half an hour is sufficient to cause the pulp on the surface in the blow tank to filtrate, or thicken, whereby a relatively solid, and continuously solidifying, pulp cake is formed onto the surface of the pulp already existing in the tank. One has to notice about the described figure that it is only an example of a batch digester and a blow as run by one operator. That is, each mill and each operator there and even each digester may produce different consistency profiles as a function of discharge time.

FIG. 2*a* illustrates a case in which the digester 10 is discharged into a blow tank 20 through a conduit 22 arranged at the upper end, more generally speaking in the upper part, of the tank. In this case it is obvious that if no auxiliary means distributing the flow are used, the pulp is discharged with a considerable force deep into the pulp already existing in the tank 20. And so, on the one hand, the pulp S filtrated on the surface in the blow tank 20 can not in any stage, except when running the tank 20 to empty it or to just lower the surface level, enter the mixing zone 24 located in the lower part of the tank, but starts to be collected on top of the pulp existing in the tank 20 and to harden, forming a solid cake. The dilute pulp, sometimes consisting of dilution liquor only, discharged deep into the pulp in the tank 20, on the other hand, forms a local agglomeration which in some stage of the even discharge of the blow tank is suddenly discharged into the mixing zone 24, causing the consistency of the pulp being discharged from the tank 20 to line 26 to decrease to a value below the desired values.

FI patents 98836 and 100011 deal partly with the same problem and suggest as a solution various apparatuses by means of which it is possible to somewhat restrict the downward flow of pulp entering the mixing zone 24 or, on the other hand, fill the blow tank 20 better than before. Said better way of filling the blow tank 20 is illustrated in FIG. 2*b* showing how by means of an apparatus 28 according to FI-patent 100011 pulp is fed into the tank 20 to a certain altitude via the bottom part of the tank. Said patent even suggests various possibilities of feeding pulp to different altitudes of the tank. Although said solution does help in many problems related to the filling of the tank, FIG. 2*b* also illustrates a situation where dilute pulp is discharged into the tank 20 through the apparatus 28. This channels directly from the inlet opening of the feeding apparatus 28, which inlet opening is located above the mixing zone 24, towards said mixing zone, resulting in principle in the same kind of situation as the solution according to FIG. 2*a*. In other words, if the feeding apparatus 28 is not capable of feeding all pulp entering the tank reliably on top of the pulp already existing in the tank, or at least into the surface layer of it, a permanent pulp layer S is left in the tank 20, which layer, constantly filtrating, gets harder and thicker. As to the feeding apparatus 28, it may be further stated that, even if it were capable of discharging the pulp into the surface layer of the pulp in the tank, it can not prevent the pulp on the perimeter of the tank from filtrating, whereby it is quite possible that the surface pulp layer S on the perimeter of the tank remains in the tank for a long time, while the pulp in the central part of the tank is channeled relatively directly to the dilution zone.

FIG. 3 illustrates how each batch digester 10 in the cooking department is connected via a flow path 32 to a blow pump 34, which further feeds the pulp to be discharged to a pressure tube 36. A valve 38 is arranged in the pressure tube 36 by means of which valve the pulp flow may be distributed either to a feed pipe 40 or 42 of the blow tank. The feed pipe 40 leads to the upper part of the blow tank 20, preferably, as illustrated in the figure, to the upper end, and feed pipe 42 to the lower part of the blow tank 20. Of course, in connection with the upper part of the tank, the pulp may be introduced via a pipe extending through a side wall of the tank as well, but even in that case so that the actual pulp feed from the pipe into the tank is practiced substantially in the vicinity of the upper end of the tank. The feeding apparatus 28 in the lower part of the tank 20 is preferably an apparatus according to FI patent 100011 illustrated already in connection with FIG. 2*b*, by means of which apparatus the feeding of the pulp into the tank is effected vertically upwards. In accordance with the invention, the valve 38 is controlled as a function of the consistency of the pulp preferably so that through the lower part of the blow tank 20, thick pulp is fed into the tank 20. The consistency range may be determined to be e.g. over 1–3%. Respectively, dilute pulp, having a consistency of e.g. below 1–3%, is fed into the blow tank 20 through the upper part thereof.

According to a preferred embodiment of the invention, the feeding apparatuses of the upper part of the tank 20 comprise an apparatus schematically illustrated under reference number 44, which apparatus distributes the pulp essentially to the whole cross section of the tank 20. This apparatus may be for example of the kind described in FI patent application 971330. The main objective of the apparatus 44 is to direct the flow of the pulp fed into the tank so that the flow can not be discharged with a great force directly downwards penetrating deep into the pulp already existing in the tank 20, but is distributed on top of the pulp already existing in the tank 20, thus keeping the consistency of the surface layer L of the pulp low. By leading the dilute pulp in this way onto the pulp in the tank 20, essentially onto the whole cross section of the tank 20, it can be considered sure that, on the one hand, the pulp L on the pulp column can at no location of the cross section of the tank 20 be filtered excessively and, on the other hand, no part of the pulp is left in the tank for too long a time, but is evenly discharged from the tank 20.

One way of controlling said valve 38 is to utilize the consistency profile of FIG. 1. Thus, e.g., if it is desirable to feed the pulp at a consistency of less than 2% through the upper part of the tank 20 onto the pulp already existing in the tank 20 and the pulp at a consistency of over 2% through the bottom part of the tank 20, the valve 38 is controlled so that when the discharge of the digester 10 initiates, the valve will immediately start to direct the pulp flow to the feed pipe 40 going to the upper part of the tank 20. According to FIG. 1, as about 5 minutes have passed from the beginning of the discharge of the digester 10, the valve 38 is turned either manually or automatically to a position by which the blow flow is guided via the feed pipe 42 through the lower part of the tank 20, preferably utilizing the feeding apparatus 28, into the tank 20. Further, when about 25 minutes have passed from the beginning of the discharge of the digester 10, the valve 38 is turned back to a position by which the blow flow is guided to the upper part of the tank 20.

Another possible method of controlling the valve 38 is to arrange a consistency detector in the blow line 32, 34 or 36 of the digesters 10, which detector guides the valve 38 automatically or on the basis of which the valve 38 is guided manually. In that case it is obvious that monitoring the consistency relatively easily leads to automatical control of the valve 38. And further, it is possible to monitor the consistency by monitoring e.g. the power requirement of the blow pump 34. It is a known fact that the power requirement of a centrifugal pump is directly proportional to the consistency of the pulp. To put it differently, when the input power of the pump 34 rises over a certain value, it means that the consistency in line 32–36 has increased over the desired value and the valve must be turned to another position. The ratio of the input power of the pump to the consistency of the pulp may be determined e.g. in connection with the implementation or manufacturing of the pump or even with test runs performed when designing the pump model.

It is also obvious that the valve 38 may also be replaced by valves positioned in both feed pipes 40 and 42, which valves are controlled to effect the model of functioning described above. Further, if there is a doubt that the valves may get clogged, it is possible to arrange at the beginning end of feed pipes 40 and 42, as a matter of fact in the distribution point of the flow a special distribution device, e.g. the one described in U.S. Pat. No. 4,964,950 specifically planned to be used in pipelines for thick pulp.

There are still other possibilities for determining the consistency. One method is to use in the discharge pipe a consistency transducer that in principle belongs to prior art, but the object of application thereof has proved to be very complicated due to e.g. the gases existing in the pulp. One possible option is the use of newer consistency meters based on e.g. ultrasound or radioactive signals, which provide for sufficiently reliable consistency detection. It is worth remembering that the consistency value in this operation needs not be anything else than reference value.

Still another method is to arrange in connection with the discharge pump information technology to such an extent that on the basis of the operating parameters, e.g. power input, of the pump it is possible to determine the changes in the consistency of the pulp. However, air and other gases in large amounts confuse the situation.

The amount of gas in the pulp pumped by the pump may be estimated if the pump is provided with gas-separation means. In that case, by e.g. keeping the suction of the gas-removal constant, on the basis of earlier test runs the total amount of gas in the pulp may be calculated from the amount of gas being discharged due to said suction.

Yet another possibility is a pre-programmed digester discharge curve and the determining of the consistency by calculating on the base of the liquor amount passing through the dilution liquor valves, which methods are in principle possible, but somewhat less exact than the techniques described above.

Still further ways of determining the consistency are offered by various devices based on process tomography which allow for the determination of both the consistency and the gas-content of the pulp.

In addition to the blow of a batch digester, the consistency of the pulp may vary during the process e.g. in connection with various presses, washers and/or various dilution devices to such an extent that the use of the apparatus according to the invention for filling the tank is well-founded.

If it comes to the solution of energy consumption only, the valve 38 or valves substituting it may be controlled based on e.g. information received from a surface level indicator of the tank.

As noticed from the above, a method and apparatus have been developed which solve the problems of prior art and by means of which e.g. the discharge of a batch digester and the further treatment of pulp discharged from the digester to the blow tank may be optimized so that the consistency of pulp going from the blow tank to brown stock washing remains within the value required by the brown stock washer. One has to notice, though, that our invention is not limited to the discharge of a batch digester to a blow tank, nor to the use of any special apparatus meant for consistency measurement. It has to be noticed that the described application of the invention to batch digesters must be understood as an exemplary application with no intention to restrict the invention to a narrower scope than described in the claims. Thus, the invention is applicable to be used in connection with any blow, storage or the like tank in the process, in which the same type of problems have been found. And accordingly, some preferable embodiments of the invention only utilize a process variable that is effected by the consistency of the pulp. In other words, numeric data on the consistency itself is not needed at any stage when applying the invention, but only an indication of the change of the consistency is needed. Thus, it is enough to arrange in the pulp flow pipe or in connection with it a device or member responding to the consistency of the pulp flowing in the pipe.

What is claimed is:

1. A method of treating pulp, by which method pulp is discharged from a process apparatus and fed into a blow tank or storage tank, wherein the method comprises:

discharging pulp from the process apparatus and feeding the pulp to the blow tank or storage tank, wherein the pulp being fed is of varying consistency;

feeding the pulp either to an upper part of the tank or to a lower part of the tank depending on a consistency of the pulp being fed from said process apparatus in such a manner that when the pulp is at a consistency below a certain predetermined discharge consistency it is fed into said tank through the upper part of the tank and when the pulp is at a consistency above said predetermined discharge consistency the pulp is fed into said tank through the lower part of the tank.

2. A method according to claim 1, further comprising controlling the feeding of pulp to the upper part and lower part of the tank by a consistency detector arranged in a discharge tube of said process apparatus.

3. A method according to claim 2, wherein said consistency detector is a blow pump.

4. A method according to claim 1, wherein said process apparatus is a batch digester.

5. A method according to claim 1, wherein the feeding of pulp is controlled according to a pre-determined consistency profile.

6. A method according to claim 5, wherein said predetermined consistency profile varies as a function of time, and whereby said feeding of pulp is controlled based on time passed from a beginning of an operation of the digester discharge.

7. A method according to claim 1, wherein the feeding of pulp through the upper part of the tank is distributed onto a whole cross section of the tank.

8. A method according to claim 1, wherein the feeding of pulp through the upper part of the tank is distributed on top of pulp in the tank.

9. A method of treating pulp, by which method pulp is discharged from a process apparatus and fed into a blow tank or storage tank, wherein the method comprises:

discharging pulp from the process apparatus and feeding the pulp to the blow tank or storage tank, wherein a consistency of the pulp changes in time;

feeding the pulp either to an upper part of the tank or to a lower part of the tank depending on the consistency of the pulp being fed from said process apparatus in such a manner that when the pulp is at a consistency below a certain predetermined discharge consistency it is fed into said tank through the upper part of the tank and when the pulp is at a consistency above said predetermined discharge consistency the pulp is fed into said tank through the lower part of the tank.

10. A method according to claim 9, further comprising controlling the feeding of pulp to the upper part and lower part of the tank by a consistency detector arranged in a discharge tube of said process apparatus.

11. A method according to claim 10, wherein said consistency detector is a blow pump.

12. A method according to claim 9, wherein said process apparatus is a batch digester.

13. A method according to claim 9, wherein the feeding of pulp is controlled according to a pre-determined consistency profile.

14. A method according to claim 13, wherein said predetermined consistency profile varies as a function of time, and whereby said feeding of pulp is controlled based on time passed from a beginning of an operation of the digester discharge.

15. A method according to claim 9, wherein the feeding of pulp through the upper part of the tank is distributed onto a whole cross section of the tank.

16. A method according to claim 9, wherein the feeding of pulp through the upper part of the tank is distributed on top of pulp in the tank.

17. A method of treating pulp, by which method pulp is discharged from a process apparatus and fed to a blow tank or storage tank, wherein the method comprises:

discharging pulp from the process apparatus and feeding the pulp to the blow tank or storage tank, wherein the pulp being fed at various times during the method has a dilute consistency and a thick consistency;

feeding the pulp either to an upper part of the tank or to a lower part of the tank depending on a consistency of the pulp being fed from said process apparatus such that the pulp at the dilute consistency it is fed to the upper part of the tank and pulp at the thick consistency is fed to the lower part of the tank.

18. A method according to claim 17 wherein the dilute consistency is a pulp consistency below a predetermined consistency and said thick consistency is above the predetermined consistency.

19. A method according to claim 17, further comprising controlling the feeding of pulp to the upper part and the lower part of the tank by a consistency detector arranged in a discharge tube of said process apparatus.

20. A method according to claim 17, wherein said consistency detector is a blow pump.

21. A method according to claim 17, wherein said process apparatus is a batch digester.

22. A method according to claim 17, wherein the feeding of pulp to either the upper part or the lower part of the tank is controlled according to a pre-determined consistency profile of the pulp.

23. A method according to claim 22, wherein said predetermined consistency profile varies as a function of time, and whereby said feeding of pulp is controlled based on time passed from a beginning of an operation of a digester discharge.

24. A method according to claim 17, wherein the feeding of pulp through the upper part of the tank is distributed over a cross section of the tank.

25. A method according to claim 17, wherein the feeding of pulp through the upper part of the tank is distributed over a top of the pulp in the tank.

* * * * *